US006547492B1

(12) United States Patent
Degville

(10) Patent No.: US 6,547,492 B1
(45) Date of Patent: Apr. 15, 2003

(54) INFLATABLE MINE SUPPORT

(75) Inventor: David N. Degville, Lexington, KY (US)

(73) Assignee: Fosroc International Limited, Swindon (GB)

( * ) Notice: Subject to any disclaimer, the term of this patent is extended or adjusted under 35 U.S.C. 154(b) by 0 days.

(21) Appl. No.: 09/762,803

(22) PCT Filed: Aug. 12, 1999

(86) PCT No.: PCT/GB99/02493

§ 371 (c)(1),
(2), (4) Date: Mar. 13, 2001

(87) PCT Pub. No.: WO00/09858

PCT Pub. Date: Feb. 24, 2000

Related U.S. Application Data

(60) Provisional application No. 60/096,639, filed on Aug. 14, 1998.

(51) Int. Cl.[7] ..... E21D 15/00

(52) U.S. Cl. ..... 405/289; 383/3

(58) Field of Search ..... 210/477, 452; 383/3, 100, 103; 405/18, 109, 115, 289, 288

(56) References Cited

U.S. PATENT DOCUMENTS

| | | | | |
|---|---|---|---|---|
| 4,309,059 A | | 1/1982 | Walsh | |
| 4,889,446 A | * | 12/1989 | Holmberg | 405/18 |
| 4,983,077 A | | 1/1991 | Sorge et al. | 405/288 |
| 5,143,340 A | | 9/1992 | Wood et al. | 248/354 |
| 5,683,182 A | | 11/1997 | Moore | |
| 5,823,718 A | * | 10/1998 | Du Plessis | 405/288 |

FOREIGN PATENT DOCUMENTS

| | | | |
|---|---|---|---|
| DE | 20 12 269 | 10/1971 | |
| DE | 32 39 483 | 4/1984 | |
| DE | 32 42 136 | 5/1984 | |
| DE | 44 02 358 | 8/1995 | |
| EP | 0 186 905 | 7/1986 | |
| FR | 2 327 392 | 5/1977 | |
| GB | 1 348131 | 3/1974 | |
| GB | 2 296 517 | 7/1996 | |
| WO | WO 91 06746 | 5/1991 | |
| WO | WO 97/47859 | 12/1997 | 15/30 |

* cited by examiner

*Primary Examiner*—David Bagnell
*Assistant Examiner*—John Kreck
(74) *Attorney, Agent, or Firm*—Nixon & Vanderhye P.C.

(57) ABSTRACT

An inflatable bag for use in a mine support has an inlet for the admission of a pumpable load bearing material such as a cementitious grout and an outlet for the air. The outlet is provided with a valve comprising a porous element the pores of which are capable of being blocked by the grout or similar load bearing material whereby the valve is closed by the grout and the pressure in the bag increased. The porous element can comprise a sponge. The bag is preferably made of a heat sealable material such as a synthetic plastics material e.g. polyethylene. The bag is used with a tube in which it is placed with the inlet in alignment with an aperture in the wall of the tube and grout pumped into the bag to inflate the bag against the floor and roof of the mine.

12 Claims, 2 Drawing Sheets

INFLATABLE MINE SUPPORT

This Application claims the benefit of No. 60/096,639 filed Aug. 14, 1998.

FIELD OF THE INVENTION

This invention relates to a novel construction of inflatable bag for use in a mine support, to a mine support incorporating the bag and also to a method of installing the support.

BACKGROUND OF THE INVENTION

Props for supporting the roof have been used in mines for many years. More recently mine supports have been developed which comprise in addition to a prop in the form of an elongate timber member, a headboard (to be placed at the upper end of the prop) on which an inflatable bag can be supported. During installation the bag is positioned in a deflated condition on the headboard, between the upper end of the prop and the mine roof. The bag is then inflated to a substantial pressure with a settable grout with the result that a substantial force is applied axially to the prop. Such mine supports have been described in U.S. Pat. Nos. 5,288,178; 5,149,228; and 5,427,476. However these supports are time-consuming to install because in many cases the props need to be sawn on site to obtain the correct length.

U.S. Pat. No. 4,277,204 describes a mining support which comprises single section or telescoping multi-section tubes made of a light sheet material containing a fabric bag which is filled with a hardenable slurry which, on hardening, forms a column to support the overburden. The casing has no supporting function and may be removed or left in place.

Alternatively, there have been proposals to employ as the prop a steel tube into which is pumped a settable load bearing material such as grout. For example, South African Patent No 90/1210 describes a mine support made of a steel tube into which a filling material such as grout is pumped. To accommodate variations in the height of the mine roof above the floor the tube is able to telescope within another tube having a ductility of at least 18%. The filling material forms a column within the tubes. The ends of the tubes are closed by a flexible sheet material which may be glued into position. This arrangement is not suitable nor intended to be pressurised. In an alternative embodiment this patent describes the provision of a separate bag which is placed in position at the top of the assembly after the tubes have been filled. The bag is then filled under pressure. The flexible character of the bag is said to result in it following the contours of the hanging wall.

Because the bag is provided as a separate part, it is necessary to discontinue the filling operation after the tubes have been filled, place the bag in position and then fill the bag under pressure whilst maintaining it in the correct position.

Patent Application No. WO 97/47859 describes a mine support which overcomes this problem in which the support comprises a tube having attached to its upper end a diaphragm which is capable of being inflated and stressed against the roof of the mine and which is sufficiently flexible to follow the surface irregularities in the roof of the mine. The support can be filled with load bearing material in a continuous operation.

Problem to be Solved by the Invention

However it has been found that there is some risk of damage during transit to the diaphragm of the mine support described in Patent Application No WO 97/47859. In addition the preferred embodiment of the mine support which has two tubes, one telescoping inside the other, requires a seal between the telescoping tubes.

The present invention provides a solution to this problem by the provision of a flexible bag for use in the tube, to which bag a load bearing material is supplied to inflate the bag against the roof of the mine.

SUMMARY OF THE INVENTION

According to the present invention there is provided a support for use in mines and other underground workings said support being inflatable by superatmospheric pressure and comprising:

(i) a tube to be installed where it is desired to provide support, the tube having (ii) a flexible bag located within the tube, the bag having an inlet for the admission of a pumpable load bearing material and an outlet for releasing air from the bag, the bag being made of a material that permits it to be inflated and stressed against the roof of the mine by the pumpable load bearing material under a superatmospheric pressure and of sufficient flexibility to follow the surface irregularities in the roof of the mine.

Advantageous Effect of the Invention

The advantage of the present invention is that the risk of damage during transit is greatly reduced and there is no need to provide a separate seal between the telescoping tubes.

DETAILED DESCRIPTION OF THE INVENTION

Figure 1:
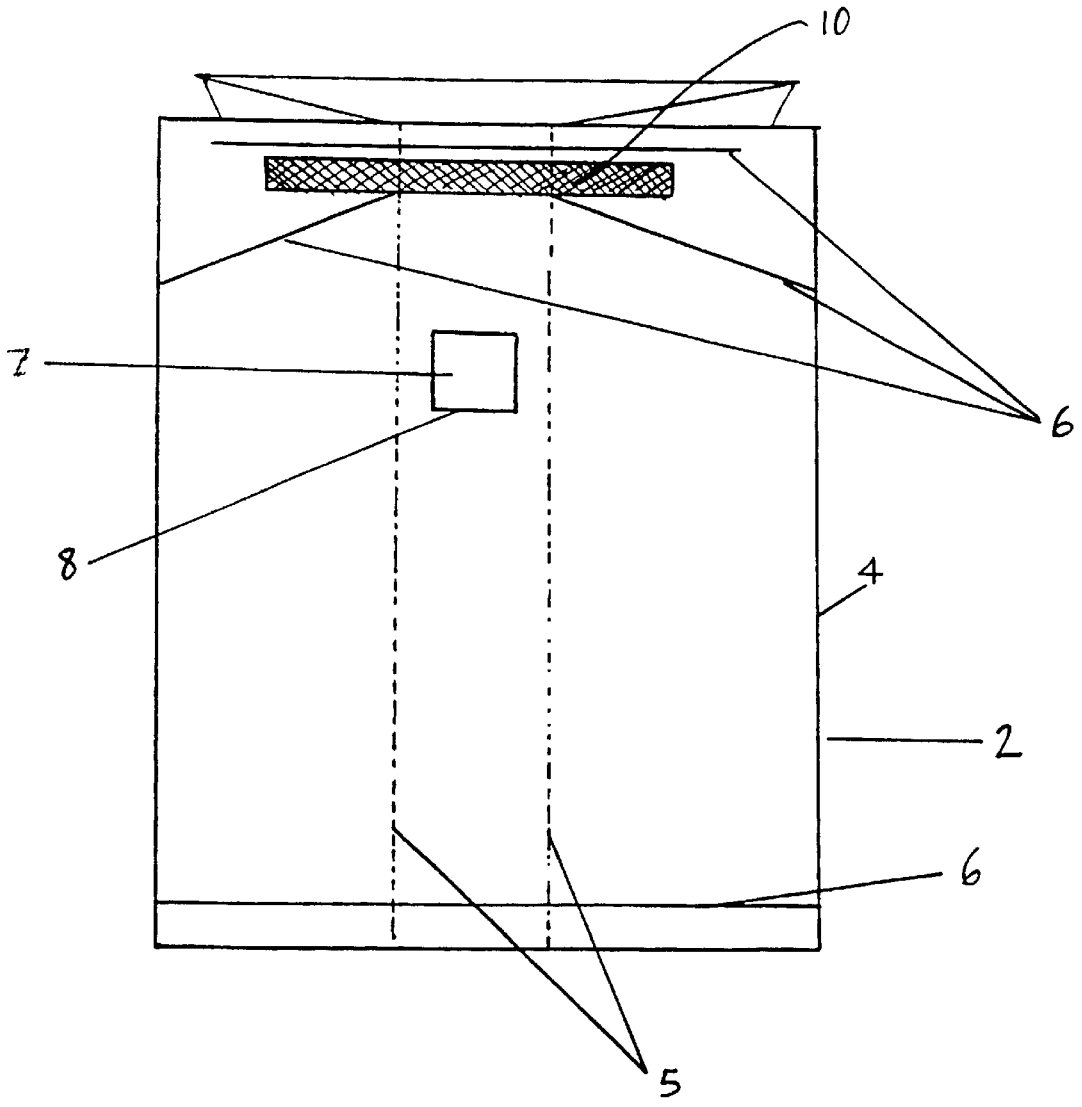
FIG. 1 is a side elevation of the bag showing the seals and folds and FIG. 2 is a vertical section showing the bag located in its tube installed between the floor and roof of a mine.

References to the bag being inflatable in the present specification are intended to embrace the capability of the bag to conform, under the application of superatmospheric pressure to the irregularities of the floor or roof as the case may be. This capability is due to its flexibility and the pressure of the load bearing material. It is not essential that the bag be made of a stretchable material (although this is preferred) and it can be fabricated of non stretchable material for example a non porous fabric such as polyvinyl chloride. In its non working state i.e. before the introduction of the load bearing material the fabric is slack or baggy and the introduction of the load bearing material causes the fabric to extend thereby removing the slack.

Suitable materials for the fabrication of the bag are polyamide and polyethylene, e.g. a low density polyethylene in sheet form. The polyethylene is preferably of a thickness of at least 5 mil, preferably 7 to 15 mil. The polyamide may be thinner, e.g. at least 2.5 mil, preferably 3 to 5 mil.

The bag needs to be capable of withstanding the superatmospheric pressure which results from the introduction of the grout. This pressure may be up to about 140 psi (about 10 bar) often not above 50 psi(about 3.5 bar) but in some cases may not be more than about 10 psi(about ⅔ bar) and sometimes about 4 psi (⅓ bar) above atmospheric pressure.

The terms top, upper and lower refer to the attitude of the support in normal use. In most cases the support will be installed in a generally upright position, but there may be situations where the strata are not horizontal. The support will be installed to span the gap between the strata i.e. across the gap so that it extends approximately transversely, preferably normally, to the strata.

The term mine is intended to include a quarry or any earthworks requiring support.

The surface irregularities in the roof or floor referred to in the present specification are those irregularities which are normally found in the roof or floor of a mine where conventional supports are or would be installed. The support of the present invention can be used where conventional supports would otherwise be used and does not require the roof or floor to be specially prepared.

The Load Bearing Material

Conveniently the load bearing material is settable and may be a cementitious grout. Suitable grouts are disclosed in GB Patents Nos 2,033,367A; 2,058,037A and 2,123,808A and U.S. Pat. Nos. 5,454,866A; 5,288,178A; 5,149,228A; 4,983,077A; 4,773,792A and 4,366,209A. The grout may be one known in the art as a high yield grout, that is of high water content, for example a ratio by weight of water: powder of 1:1 to 4:1. The grout may be a fast setting grout e.g. a cement/bentonite mix.

A grout sold under the registered trade mark "Tekblend" by Fosroc International is particularly suitable.

The Tube

The purpose of the tube is to support the bag whilst it is being inflated and when deformation occurs when the support yields.

The tube should be self supporting and is preferably rigid.

The tube need not have a circular cross section, although this is preferred, and may have for example, an oval cross section.

It is preferred that the tube comprises two tubular sections, one being a telescopic fit in the other.

The sections may be connected by a screw threaded engagement.

Preferably the upper section telescopes inside the lower section.

More than two tubular sections may be employed, in a series of telescopic arrangements.

Preferably the tube is made of steel preferably a mild steel, which may have a ductility of at least 18% or at least 20%. The steel may be an annealed mild steel, since annealing increases the ductility.

A particularly preferred steel is one conforming to ASTM A653/A653M-94.

The thickness of the steel is preferably at least 0.04 (one twentyfifth) of an inch. There is no upper limit on the thickness and this will be determined by weight and the cost of the steel.

The length of the overlap between the sections is conveniently from one inch to 2.5 feet, and is preferably from 3 to 12 inches.

The combined length of the two sections of tube can be any value up to about 15 feet to suit the height of the aperture to be supported. Typically the lower section i.e. the section of larger diameter, will be from 2 to 7 feet in length, more conveniently, 3 to 6 feet in length and the upper section from 1 to 5 feet more conveniently from 2 to 4 feet in length.

The diameter of the tube of larger diameter can be from about 9 inches to 8 feet but will usually be in the range from 1 to 4 feet and often from 1 to 2.5 feet. The diameter of the smaller tubular section will be slightly less since it is in a telescopic fit in the larger tubular section.

The two sections may be conveniently of about the same length so they can be nested together for space saving during transport or storage.

The support has means for allowing air to escape when the load bearing material is introduced. This means may comprise a porous sponge—like material located between two seals near or at the top of the bag and arranged so that all the air escaping from the bag must pass through the sponge. Displaced air will pass through the sponge easily but the grout will quickly block the sponge due to the particles of cement blocking the pores in the sponge and subsequent setting. When the sponge has been blocked continued supply of grout builds up the pressure and ensures good contact with the roof of the mine.

The size of the outlet and its valve will be chosen so that when the load bearing material is pumped into the bag, air can be released reasonably quickly, to thereby permit the load bearing material to be admitted at a useful rate without causing a significant pressure increase in the bag before the valve is blocked.

The pump operator can decide when to terminate pumping from the appearance of the bag e.g. a full or swollen bag indicates that the pressure has been built up.

According to another aspect of the present invention there is provided an inflatable bag suitable for use as a mine support the bag having an inlet for the admission of a pumpable load bearing material such as a grout and an outlet for the air, said outlet being provided with a valve comprising a porous medium the pores of which are blocked by a grout or similar load bearing material whereby the valve is closed by the grout and the pressure in the bag increased.

The bag may be used with a tube or other crib such as a wooden prop as described in U.S. Pat. Nos. 5,288,178; 5,149228 and 5,427,476.

According to a further aspect of the invention a method of providing support in a mine or other underground working comprises installing a support as hereinbefore defined at the underground location and introducing the load bearing material into the bag and releasing air from the bag and, under the action of superatmospheric pressure, inflate and stress the bag against the roof of the mine.

Preferably the support is installed in an attitude that is approximately transverse to the strata. In most cases the strata will run horizontally and this will be an upright attitude.

The method preferably employs a tubular support comprising two tubular sections, the upper section being a telescopic fit in the lower section and extending the telescoping sections to fit the gap between the floor of the mine and the roof and then introducing the load bearing material into the bag within the tubular sections.

Figure 2:
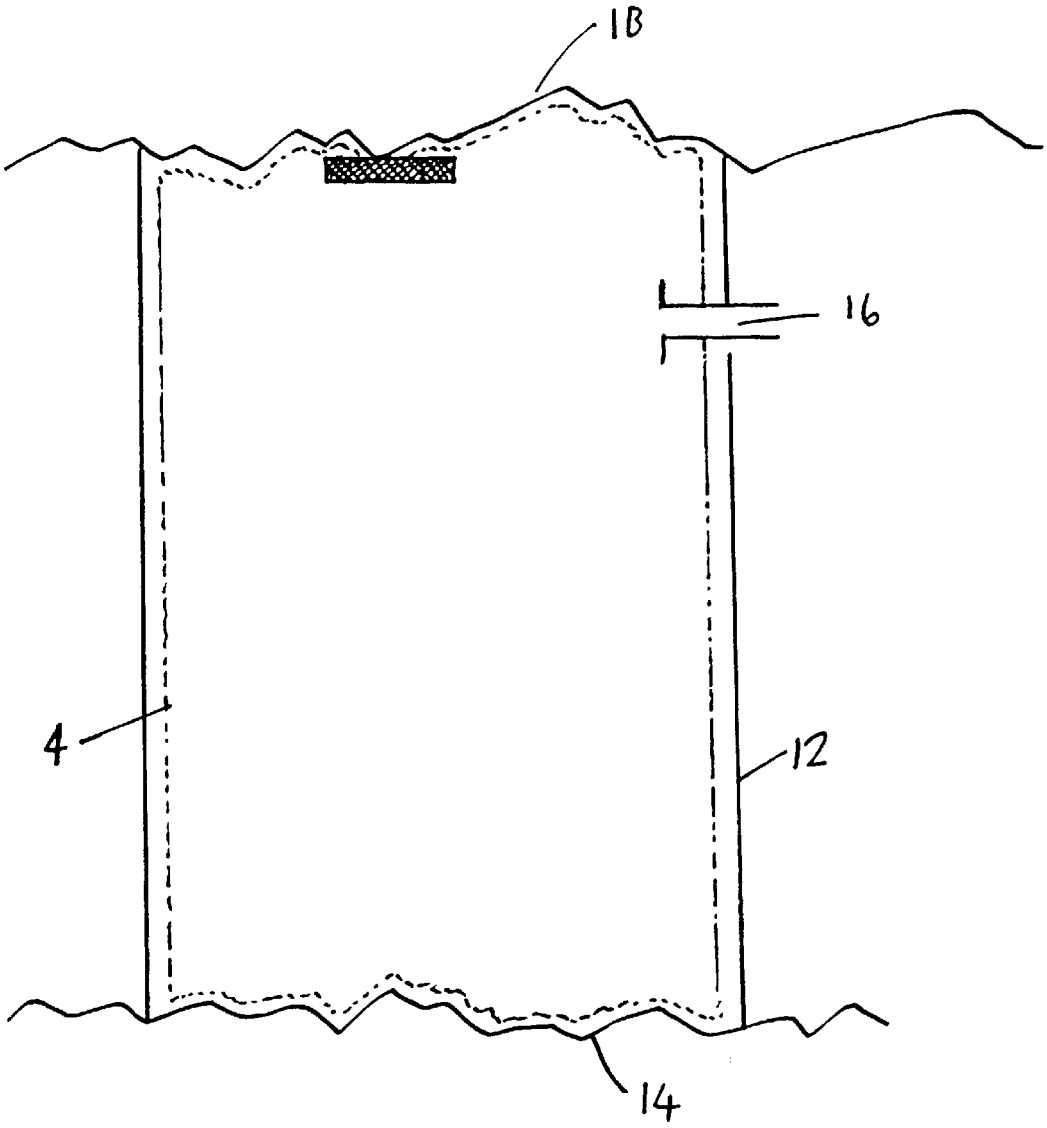

Referring to the drawings a bag indicated generally by numeral 2 is made of polyethylene tube 4 of wall thickness about 7 mils (thousandths of an inch). The bag has gussets or folds 5 and is heat sealed along lines 6. An inlet 7 for the admission of a pumpable load bearing material is provided by an aperture 8 in the bag. The bag has an outlet for air expelled by the admission of the load bearing material which outlet comprises a porous element in the form of a sponge 10. In FIG. 2 the bag 4 is shown located within a steel tube 12 and the tube and bag are in position between the floor 14 and roof 18 of a mine. The tube 12 has an aperture 16 which is in alignment with the inlet 7 of the bag.

In use the bag 2 is placed inside the tube 12 so that its inlet 7 is in alignment with the aperture 16 in the wall of the tube and installed in an upright position between the floor and roof of a mine where it is desired to provide support. A cementitious grout is pumped into the bag and air is displaced and exits through outlet valve 10. The rate at which the grout is pumped into the bag is adjusted in accordance with the rate of escape of air to avoid significant pressure build up before the grout reaches and blocks the valve. When the air has been expelled, grout then passes through the pores of the sponge which are rapidly blocked by the grout. This provides an automatic closing of the valve without the need for operator intervention. Further admission of grout inflates the bag into contact with the floor 14 and roof 18 of the mine. The operator can judge visually when to cease pumping.

The advantages of the above described mine support are:

(i) there is no need to provide a seal between the telescoping tubes (ii) the diaphragms attached to the ends have been eliminated and as a result there is no longer a risk of their being damaged in transit or of leakage from them (iii) the support is of lower cost than that described in Patent Application No. WO 97/47859

(iv) the pump operator can judge visually when to terminate pumping (v) the valve incorporating the porous element provides a valve that will automatically shut off without the need for intervention by the operator.

What is claimed is:

1. A support for use in mines and other underground workings, said support being inflatable by superatmospheric pressure and comprising:

(i) a tube to be installed where it is desired to provide support the tube having (ii) a flexible bag located within the tube having an inlet for the admission of a pumpable load bearing material and an outlet for releasing air from the bag, the outlet comprising a porous element which is capable of transmitting air but which is capable of being blocked by the load bearing material, the bag being made of a non porous material that permits it to be inflated and stressed against the roof of the mine by the pumpable load bearing material under a superatmospheric pressure and of sufficient flexibility to follow the surface irregularities in the roof of the mine.

2. A support as claimed in claim 1 wherein the outlet for the release of air is located near the top of the bag.

3. A support as claimed in claim 1 wherein the wall of the tube has an aperture which is in alignment with the inlet in the bag.

4. A support as claimed in claim 1, wherein said load-bearing material is grout, and wherein said porous element includes pores which are capable of being blocked by the grout whereby the porous material is closed by the grout and the pressure in the bag increased.

5. A support as claimed in claim 1 or 4, wherein the porous element comprises a sponge.

6. A support as claimed in claim 1, wherein the bag is made of a heat sealable material.

7. A support as claimed in claim in claim 6, wherein the thickness of the material used to make the bag is at least 5 mil.

8. A support as claimed in claim 8, wherein the heat sealable material is a synthetic plastics material.

9. A support as claimed in claim 1, wherein the bag is capable of withstanding a pressure of at least 10 pounds per square inch above atmospheric pressure.

10. A method of providing support in a mine or other underground working which method comprises installing a support as claimed in claim 1 at the underground location and pumping the load bearing material into the bag and releasing air from the bag to fill the bag and, under the action of superatmospheric pressure, inflate and stress the bag against the roof of the mine.

11. A method as claimed in claim 10 wherein the load bearing material is a cementitious grout.

12. A method as claimed in claim 10 wherein the pumping of the load bearing material generates a pressure in the range from 4 psi to about 140 psi above atmospheric pressure within the bag.

* * * * *